United States Patent [19]

Sartor et al.

[11] Patent Number: 4,944,100

[45] Date of Patent: Jul. 31, 1990

[54] CLOSURE AND ADJUSTMENT DEVICE, PARTICULARLY FOR SKI BOOTS

[75] Inventors: Mariano Sartor, Montebelluna; Valerio Tonel, Barbisano, both of Italy

[73] Assignee: Nordica S.P.A., Montebelluna, Italy

[21] Appl. No.: 436,849

[22] Filed: Nov. 16, 1989

Related U.S. Application Data

[62] Division of Ser. No. 78,986, Jul. 29, 1987.

[30] Foreign Application Priority Data

Aug. 1, 1986 [IT] Italy ..... 82566 A/86
Oct. 29, 1986 [IT] Italy ..... 59462/86[U]
Oct. 29, 1986 [IT] Italy ..... 59464/86[U]

[51] Int. Cl.[5] ..... A43B 5/04
[52] U.S. Cl. ..... 36/120; 36/121
[58] Field of Search ..... 36/117–121, 36/50

[56] References Cited

U.S. PATENT DOCUMENTS 3,861,067 1/1975 Koyama et al. ..... 36/120
4,085,528 4/1978 Delery ..... 36/121
4,199,879 4/1980 Wegeng ..... 36/121
4,476,640 10/1984 Aldinio et al. ..... 36/121
4,620,379 11/1986 Sartor ..... 36/119
4,769,929 9/1988 Sartor ..... 36/117
4,785,555 11/1988 Sartor ..... 36/119

FOREIGN PATENT DOCUMENTS 0117430 9/1984 European Pat. Off. ..... 36/120
0259740 3/1988 European Pat. Off. ..... 36/117
3618922 1/1987 Fed. Rep. of Germany ..... 36/117
2416661 12/1979 France ..... 36/121

*Primary Examiner*—Paul T. Sewell
*Assistant Examiner*—Andrew D. Meyers
*Attorney, Agent, or Firm*—Guido Modiano; Albert Josif

[57] ABSTRACT

The closure and adjustment device is particularly for ski boots comprising a front quarter and a rear quarter pivoted to a shell. The rear quarter is connected to at least one mutually movable part of the boot through at least one connecting element. The rear quarter and the connecting element are provided with a set of teeth and a bar respectively for the adjustment and locking of the position of the connecting element, for effecting adjustment of the closure of said quarters.

7 Claims, 8 Drawing Sheets

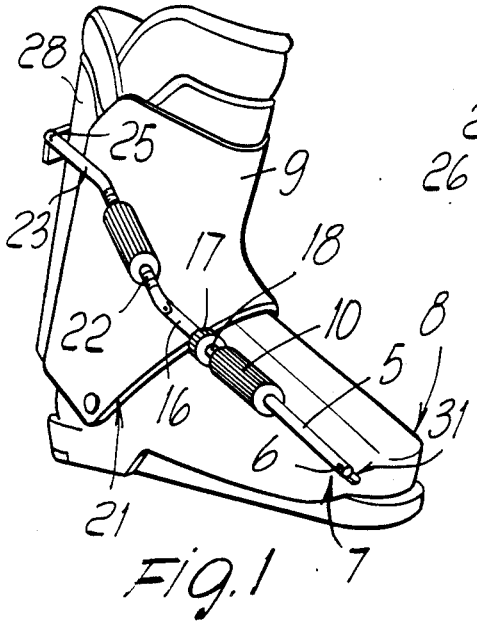
Fig. 1
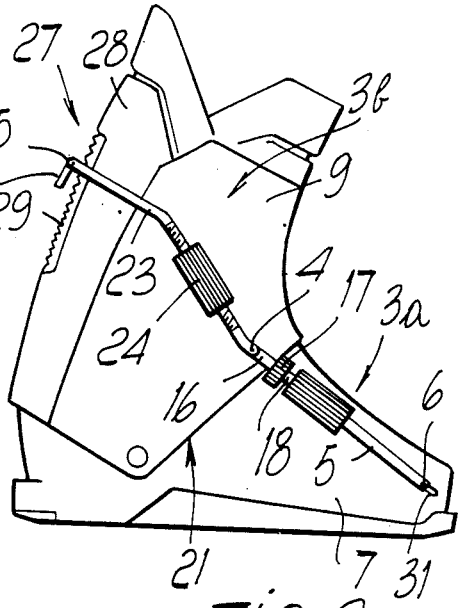
Fig. 2
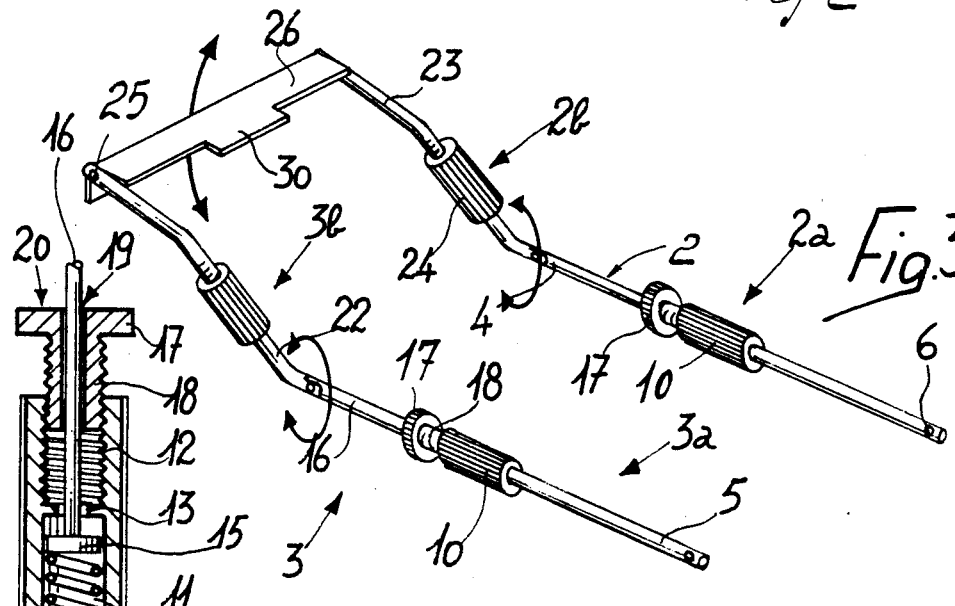
Fig. 3
Fig. 4
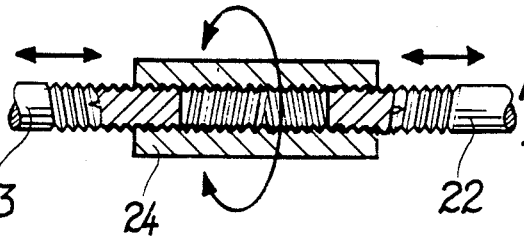
Fig. 5

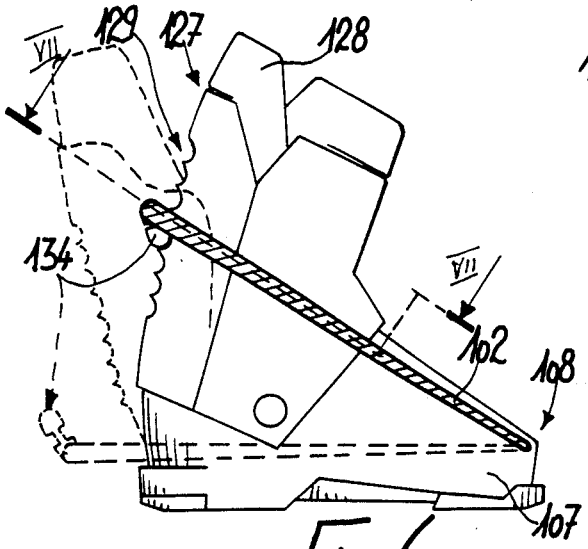
Fig. 6
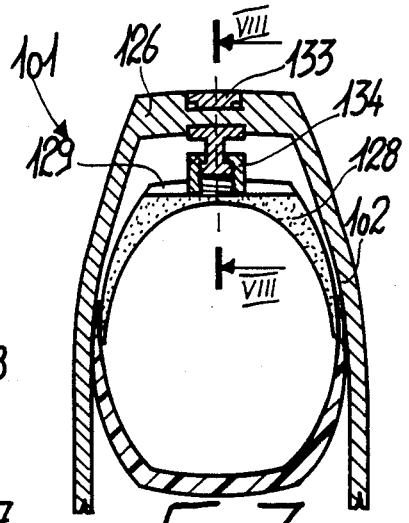
Fig. 7
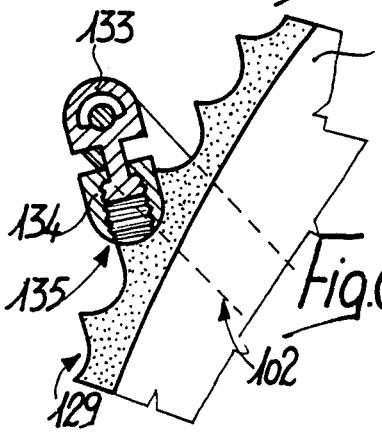
Fig. 8
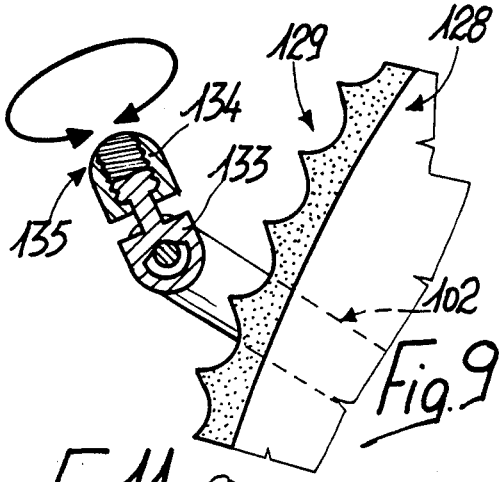
Fig. 9
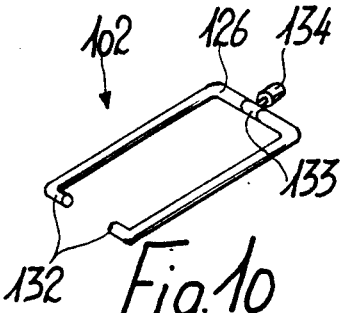
Fig. 10
Fig. 11
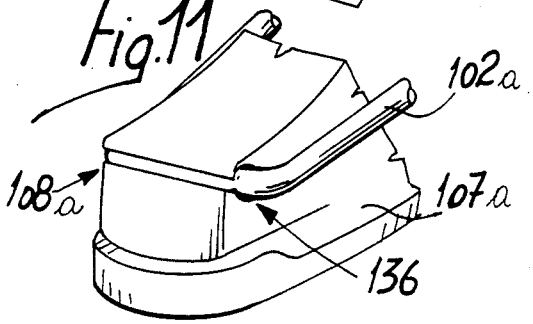

201
214
212
221
224
205
210
9
204
207
208
203
217
219
202

204
206
221
224
207
201
208
203
219
217
216
225
220
222
202
223

220
218
217
224
221
219

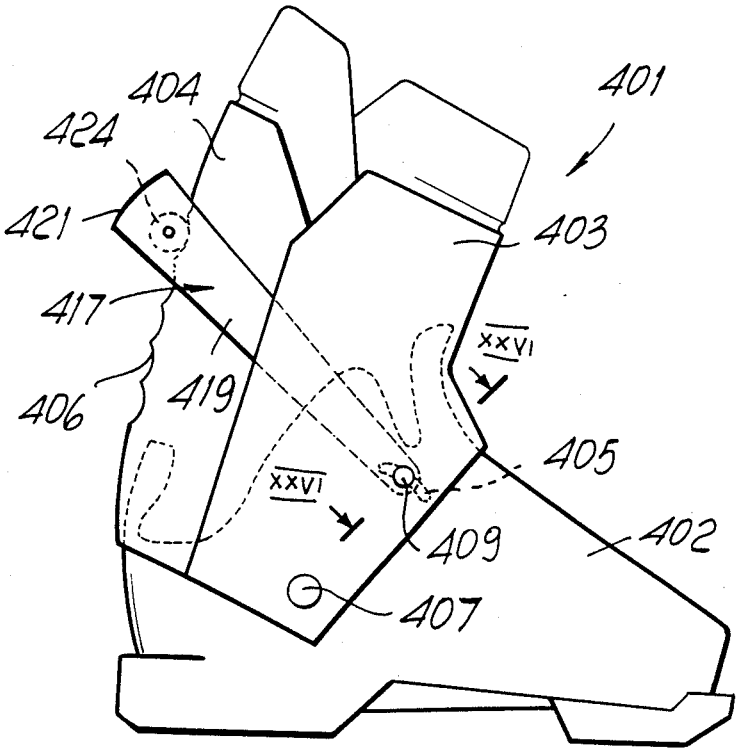
Fig. 25
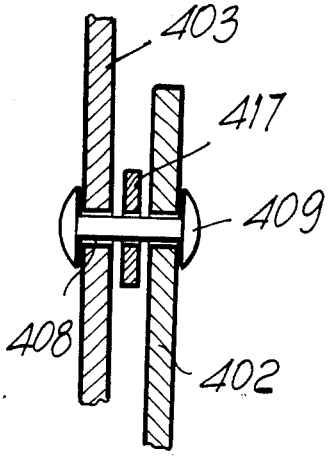
Fig. 26
Fig. 27
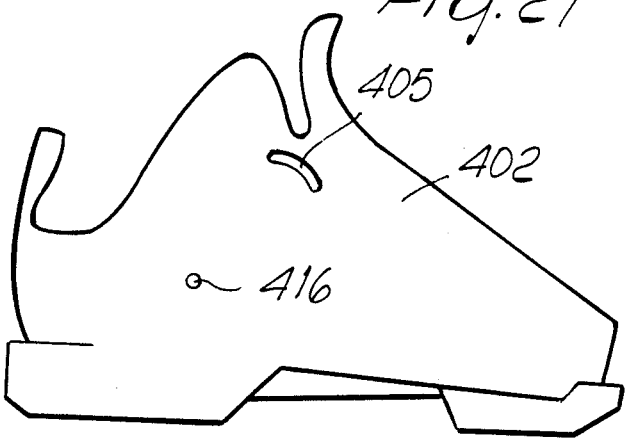

CLOSURE AND ADJUSTMENT DEVICE, PARTICULARLY FOR SKI BOOTS

This is a division, of application Ser. No. 07/078,986, filed July 29, 1987.

BACKGROUND OF THE INVENTION

The present invention relates to a closure and adjustment device, particularly for ski boots.

The use in ski boots is currently known of individual devices for the adjustment of the inclination of the quarters or for the adjustment of the degree of fastening thereof or for the adjustment of the stroke, in the flexing phase, of the front quarter with respect to the base.

Such known devices, if they are present in combination, are in any case independent from one another, and therefore require individual adjustments.

The use of a plurality of individual devices applied to the boot furthermore creates the problem of their location also with respect to the dimensions and the final overall weight of the boot.

SUMMARY OF THE INVENTION

The aim of the present invention is therefore to eliminate the disadvantages described above in known types, by devising a single device which allows to adjust both the closure of the quarters and the inclination thereof with respect to the longitudinal axis of the shell, as well as the flexing stroke of the front quarter.

Within the scope of the aim described above, an important object is to provide a device which associates with the preceding characteristics that of increasing the lateral hold of the boot.

Another important object is to provide a device which is structurally simple, rapid and easy to use.

Not least object is to obtain a device which has modest costs and is therefore competitive from a merely economical point of view.

The intended aim and objects, as well as others which will become apparent hereinafter, are achieved by a closure and adjustment device, particularly for ski boots comprising a front quarter and a rear quarter pivoted to a shell, characterized in that said rear quarter is connected to at least one mutually movable part of said boot by means of at least one connecting element, said rear quarter and said connecting element being provided with means for the adjustment and locking of the position of said connecting element for an adjustment of the closure of said quarters.

BRIEF DESCRIPTION OF THE DRAWINGS

Further characteristics and advantages of the invention will become apparent from the detailed description of a preferred, but not exclusive, embodiment, illustrated only by way of non-limitative example in the accompanying drawings, wherein:

FIG. 1 is a perspective view of a ski boot with a closure and adjustment device according to a first aspect of the invention;

FIG. 2 is a lateral elevation of the boot of FIG. 1;

FIG. 3 is a perspective detail view of the device;

FIG. 4 is a detailed cross section view of a means for the adjustment of the flexing stroke;

FIG. 5 is a view, in partial cross section, of a means for the adjustment of the extension;

FIG. 6 is a schematic lateral elevation view of a boot with a device according to a second aspect of the invention;

FIG. 7 is a cross section view along the line VII—VII of FIG. 6;

FIGS. 8 and 9 are cross section views of a detail of the device in two different operating positions;

FIG. 10 is a perspective detail view of the device of FIG. 6;

FIG. 11 is a perspective view of the boot of FIG. 6;

FIG. 25 is a lateral elevation view of a boot with a device according to a fifth aspect of the invention;

FIG. 26 is a cross section view along the line XXVI—XXVI of FIG. 25; and FIG. 27 is a lateral elevation view of the shell of the boot.

DESCRIPTION OF THE PREFERRED EMBODIMENTS

Figures 12, 13, 14:
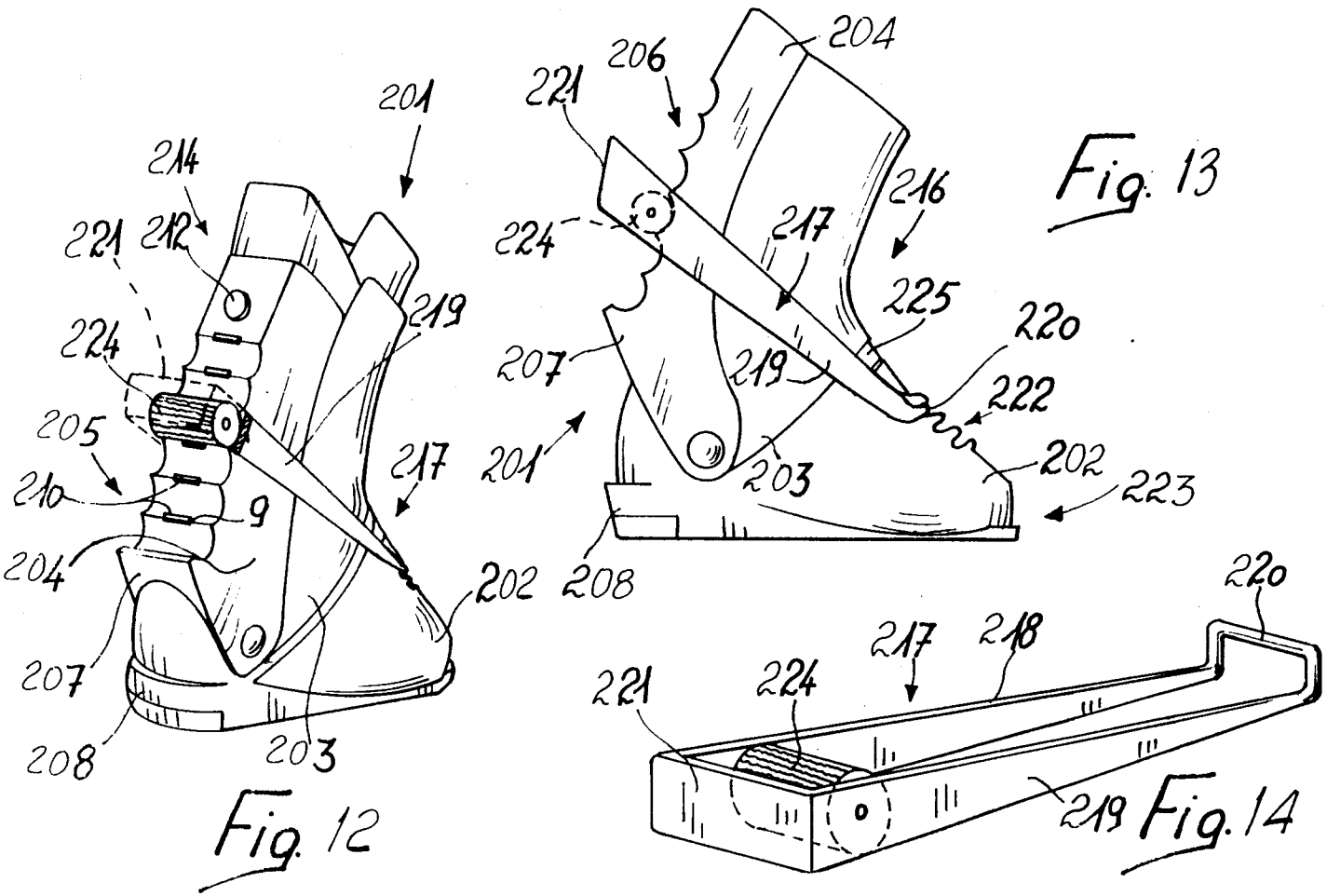
FIG. 12 is a perspective view of a boot with a device according to a third aspect of the invention.
FIG. 13 is a lateral elevation view of said boot.
FIG. 14 is a perspective view of a detail of the device.

With reference to FIGS. 1–5 the device 1 is composed of a pair of mutually identical rod-like elements, indicated by the reference numerals 2 and 3, each whereof is advantageously divided into a first half-element, indicated by the numerals **2*a* and 3*a*, and into a second half-element, indicated by the numerals 2*b* and 3*b*, idly pivoted to one another by means of a first small pivot 4**.

Each of said first half-elements **2*a* and 3*a* is composed of a first small rectilinear rod 5 one end whereof is idly pivoted, by means of a second small pivot 6, laterally with respect to the shell 7 at the tip region 8**.

A means for the adjustment of the flexing stroke of the front quarter 9 is rigidly associated with the other end of said first rod 5, said means consisting of a substantially cylindrical body 10, knurled externally and internally provided with a first axial cavity 11 and with a second axial cavity 12, said cavities being divided from one another by means of an axially foraminous dividing wall 13.

A cylindrical helical compression spring 14 is arranged inside the first cavity 11 and interacts with a small plate 15 which is slideable within said cavity and is connected to the end of a second rectilinear rod 16 which passes through the dividing wall 13, affecting the second cavity 12 and pivoted at its end to the second rod-like element.

An adjustment ring 17 is associable with the second internally threaded axial cavity 12, and is provided with a complementarily threaded tang 18.

Said ring 17 is provided with an axial seat 19 for the passage of the second rod 16.

The planar surface 20 of the head of the ring 17 interacts in abutment engagement with the ends 21 of the front quarter 9 facing towards the region of the tip 8, said front quarter having, at the ends 21, a thickness sufficient to interact with the ring 17.

Each of the second half-elements **2*b* and 3*b* is instead composed of a first rod 22, pivoted at one end to the second small rod 16**, which has a slightly curved shape in the direction of the upper end of the boot, its free end being threaded.

The second half-element **2*b* and 3*b* is also composed of a second small rod 23 also provided with an end threaded in the opposite direction with respect to the end of the rod 22, said end cooperating with a means for the adjustment of their distance, consisting of a sleeve 24** which is internally threaded in a single direction.

Each of the non-threaded ends of the second rod 23 which constitutes said second half-elements **2*b* and 3*b* is pivoted, by means of a third small pivot 25, to a locking-unlocking element consisting of a bar 26** having an L-shaped cross section.

Said bar is arranged transversely with respect to the boot and affects the rear region 27 of the rear quarter 28.

A set of teeth 29 is associated with said rear quarter at said region, and is arranged longitudinally with respect to said quarter, with which interacts an adapted cam 30 which projects from the flap of the bar 26 which can be arranged approximately perpendicular to said set of teeth 29. Said set of teeth is obtained monolithically with the quarter or is added thereto. The use of the device 1 is thus as follows: once the skier has put the boot on, he can operate a rough adjustment of the fastening between the front quarter 9 and the rear quarter 28 by arranging the cam 30 of the bar 26 on the set of teeth 29 at the point corresponding to the optimum tensioning.

This operation is facilitated by the fact that the second half-elements **2*b* and 3*b* are idly pivoted to the first half-elements 2*a* and 3*a***.

The arrangement of the bar 26 furthermore allows to fasten the quarters, also constituting a rest for the rear quarter which is useful most of all during the phases of extension while skiing.

The skier can subsequently rotate the sleeve 24 appropriately and therefore move mutually closer or further apart the threaded ends of the first small rod 22 and of the second small rod 23.

This adjustment allows to vary by the desired angle the inclination of the front quarter 9 with respect to the longitudinal axis of the shell.

While skiing, and in particular during flexing, the device 1 furthermore allows to adjust the forward stroke of the front quarter 9: first of all it is possible to define a stroke limit by appropriately screwing or unscrewing the ring 17, the distance between the planar surface 20 of its head or that of the end 21 of the front quarter defining the free excursion which can be performed by the latter.

The presence of the small plate 15 at the end of the second rectilinear rod 16 allows, by virtue of the interaction with the spring 14, to dampen the stroke of the second rod 16.

In order to allow a further sliding at the first half-elements **2*a* and 3*a*, a slot 31 is advantageously provided on the shell 7 and has the same longitudinal axis as said half-elements, within which said second small pivot 6** can idly slide.

FIGS. 6–10 illustrate a device 101 according to another aspect of the invention, consisting of a single essentially U-shaped rod-like element 102, at the ends of its arms there protruding two teeth 132 which are arranged mutually facing and insertable in adapted seats provided laterally with respect to the shell 107 at the tip region 108. A locking-unlocking element is associated with the bar 126 which affects the rear region 127 of the quarter 128 and consists of a pawl 133 idly pivoted at one end to said bar 126. The other end of the pawl is externally threaded and interacts with a complementarily threaded bush 134 the head 135 whereof is shaped complementarily with respect to the individual seats of the set of teeth 129 provided on the rear quarter 128. Said set of teeth preferably constitutes a single element with the quarter 128 and has a curved profile with its center in the pivoting point of the teeth 132. This allows to easily rotate the element 102 during the operations of opening and closure of the quarters, these operations being rapid and easy for the skier, since he merely has to place the bush 134 in the most appropriate point in order to achieve the optimum fastening of said quarters. Moreover, by positioning the bar 126 more or less high with respect to the rear quarter 128 it is possible to vary the rear resting characteristics. FIG. 11 illustrates another embodiment of the rod-like element, consisting of a single element **102*a*, in the shape of a closed loop, the front end whereof is associable with a transverse seat 136 provided on the shell l107*a* at the tip region 108*a***.

With reference to FIGS. 12–17, the reference numeral 201 indicates a rear-entry ski boot consisting of a shell 202 whereto are hinged a front quarter 203 and a rear quarter 204.

A first transverse set of teeth 206 is provided on said rear quarter in the rear region 205, and ends with an arrestor tooth 207 which protrudes from said quarter 204 from its end adjacent to the heel 208 of the boot 201.

A safety element is furthermore associated with the quarter 204: in fact, transverse slots 209 are provided at said first set of teeth 206 and constitute seats for teeth 210, slideable therein and protruding therefrom, rigidly associated with a rigid body 211 arranged inside the quarter 204 and pivoted thereto at an end proximate to the arrestor tooth 207.

An operating button 212 is provided at the other end of said rigid body 211 and protrudes outside the quarter 204 through an adapted opening 213 provided proximate to the upper end 214 of said quarter 204.

The teeth 210 normally protrude out of the slots 209 by virtue of the presence of a first elastically deformable element 215 interposed between said quarter 204 and said rigid body 211.

The closure device structure 216 comprises a rod-like element 217 consisting of a single bracket, provided with two lateral wings 218 and 219 each arranged to one side of said quarters 203 and 204, and with two cross-members, a front one 220 and a rear one 221 which faces said set of teeth 206. The cross-member 220 can be interrupted at the middle region.

The front cross-member 220 is shaped so as to be removably and selectively pivotable to a second set of teeth 222 formed transversely with respect to said shell 202 proximate to the region 223 of the tip of the boot 201.

A preferably rubber-covered roller 224 is instead pivoted between the wings 218 and 219, adjacent to the rear cross-member 221, and has such a diameter as to be arrangeable between two adjacent teeth 210.

The roller 224, though it rotates in contact with the set of teeth 206 and with the teeth 210 during the lifting or the lowering of the rear cross-member 221, causes no scraping and facilitates the sliding.

The adoption of elastic material allows to recover any mutual movements between the rear quarter 204 and the roller 224 while skiing.

Advantageously, the rear cross-member 221 furthermore constitutes a grip handle for the skier.

A second elastically deformable element 225 cooperates with the elastic return of the front quarter 203 during the extension phase, and is interposable between said shell 202 and said front quarter 203. This second elastically deformable element 225 can consist of a longitudinal tab of the front quarter, or of a small rubber block or of another technically equivalent element.

The use of the structure of a closure device 216 initially entails the positioning of the front cross-member 220 at the second set of teeth 223.

When the quarters are open, and therefore in the condition of maximum opening, the roller 224 abuts on the arrestor tooth 207 and thus prevents the excessive lowering of the rod-like element 217, thus allowing a good stride in walking. Once the quarters are moved close to one another, the skier positions the roller 224, raising, manually or by means of the other boot, the rear cross-member 221 along the set of teeth 206, so as to achieve the desired degree of fastening of said quarters.

The presence of the teeth 210 allows to prevent any accidental uncoupling, intentional uncoupling being achieved by pressing the button 212 and then making said teeth 210 re-enter the slots 209.

The possibility of varying the positioning of the front cross-member 220 on the second set of teeth 223, thus varying the pivoting point of the rod-like element 217, allows for example to obtain more or less marked degrees of fastening, or vice versa, keeping invariant the rigidity of the rear rest, which is given by the height of the roller on the rear quarter 204.

The presence of the roller 224 furthermore allows not to subject to wear the rear region 205 of the quarter 204, the wings 218 and 219 conferring a considerable lateral rigidity to the boot.

It is thus possible to obtain a greater sensitivity on the skis, imparted by the rod-like element 217 fixed to the shell 202 which transfers the rigidity to the upper part of the boot, increasing the arm of the transmission of the forces.

Figures 15, 16, 17:
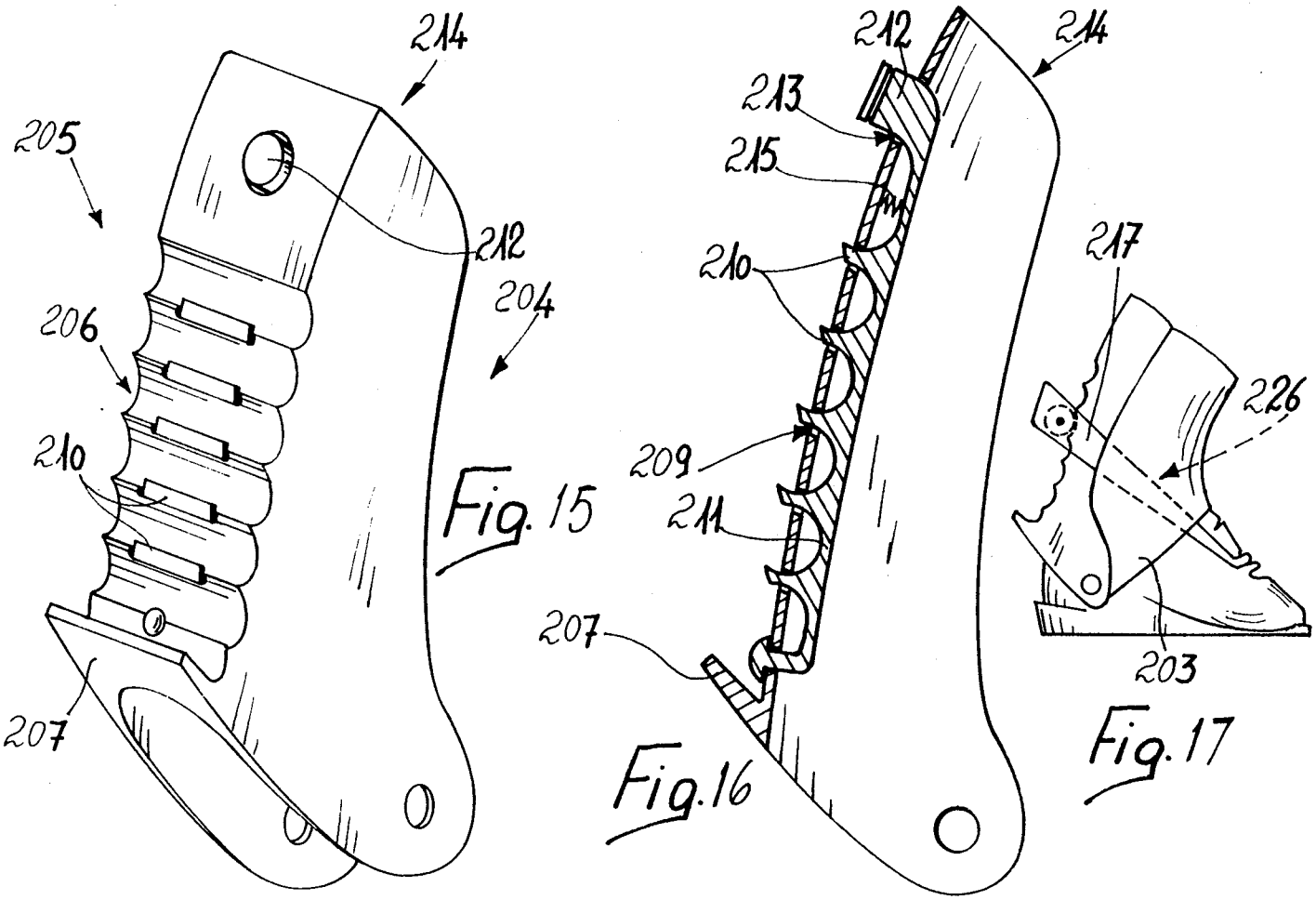
FIG. 15 is a perspective view of the rear quarter of the boot.
FIG. 16 is a cross section view of the rear quarter along a middle longitudinal plane.
FIG. 17 is a lateral elevation view of a different arrangement of the device in the boot.

Moreover, the rod-like element 217, as illustrated in FIG. 17, can be provided with a portion 226 of the wings arranged at the inner lateral surface of the front quarter 203. This allows to improve the aesthetics of the boot 201 though keeping invariant the functional characteristics.

Figure 18:
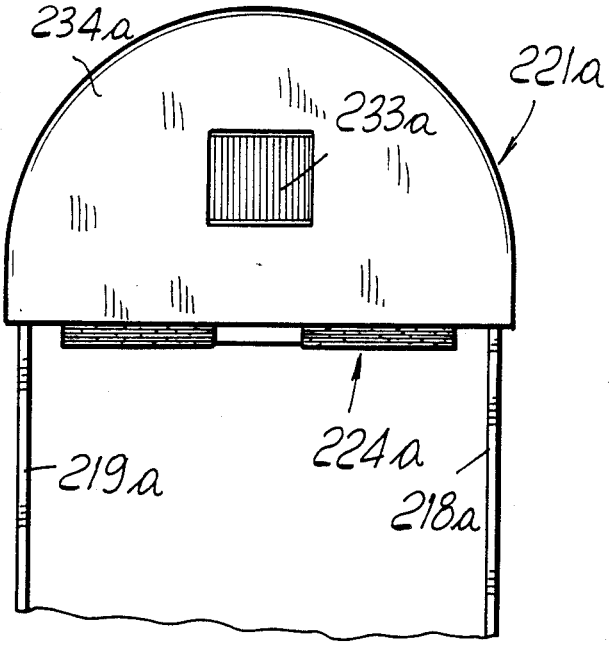
FIG. 18 is a top view of an adjustment block.
Figure 19:
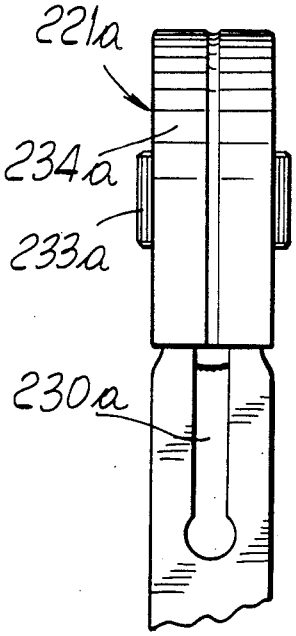
FIG. 19 is a lateral view of the adjustment block.
Figure 20:
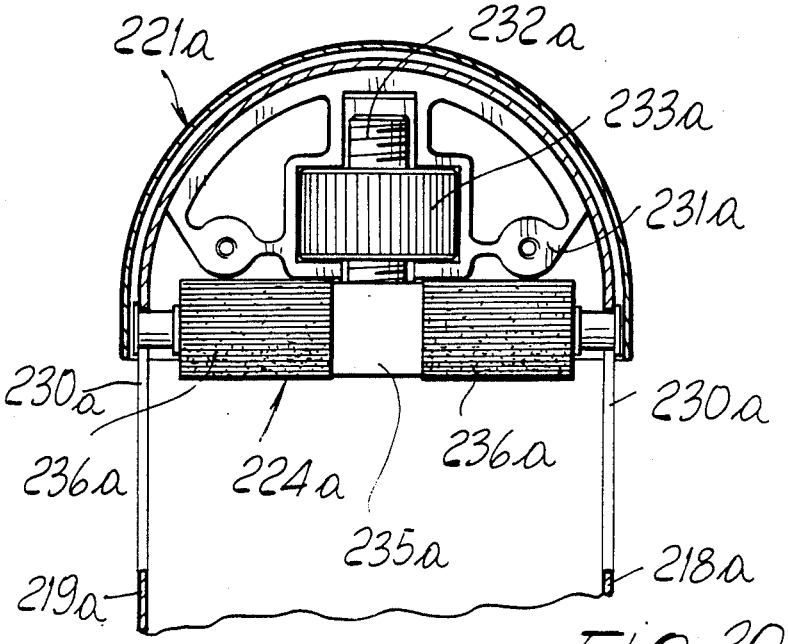
FIG. 20 is another top sectional view of the adjustment block.

FIGS. 18–20 illustrate another embodiment of the bracket 217, provided with the lateral wings 218*a* and 219*a* the rear ends whereof are associated with an adjustment block 221*a* which supports the roller 224*a* so as to allow the adjustment of its position along the wings of the bracket.

The block 221*a* is provided with a framework 231*a* which rotatably supports a ring 233*a*; the ring 233*a* in turn engages a threaded bar 232*a*, arranged parallel to the lateral wings 218*a* and 219*a* of the bracket, so that by rotating the ring 233*a* the bar 232*a* is moved along a direction which is perpendicular to the rear surface of the quarter 204 provided with the set of teeth 206, the ring 233*a* being axially blocked.

A roller 224*a* is connected to the end of the bar 232*a* facing the set of teeth 206, and consists of a supporting bar 235*a* fixed perpendicular to the bar 232*a* and supporting the rollers 236*a*. The supporting bar 235*a* is furthermore provided with its ends engaged in the slots 230 longitudinally provided on the wings 218*a* and 219*a*. In this manner, by rotating the ring 233*a*, the position of the roller 224*a* along the bracket 217 is adjusted, obtaining a further fine adjustment of the fastening of the quarters.

Advantageously, the block 221*a* is furthermore provided with a covering shell 234*a* which has two symmetrical openings on the opposite sides, from which the ring 233*a* partially protrudes to allow its operation. Naturally the covering shell 234 is provided with an opening also at the roller 224*a*.

With reference now to the above described FIGS. 21–24, the reference numeral 301 indicates a rear-entry ski boot, consisting of a shell 302 whereto are pivoted a front quarter 303 and a rear quarter 304, and provided with a closure and adjustment device according to another aspect of the invention.

The rear quarter 304 is provided, on the rear region 305, with a transverse set of teeth 306.

The device 307, according to the invention, comprises a rod-like element 308 consisting of a single essentially U-shaped bracket the wings or legs 309 and 310 whereof are idly pivoted, proximate to the free ends, to the front quarter 303. Said rod-like element 308 is then provided with a transverse body portion in the form of a planar base 311, which connects the wings 309 and 310, and faces the set of teeth 306 provided on the rear quarter. The rear region 305 of the latter is conveniently slightly curved to facilitate the rotation imparted to the rod-like element by the user.

An essentially rectangular opening 312 is provided at said planar base 311 and acts as a seat for a lever 313.

Said lever is idly pivoted, by means of a pivot 314, eccentrically and transversely with respect to the opening 312, the pivot 314 being adjacent to the end of the opening facing towards the heel of the boot.

This locking-unlocking lever has its ends curved in opposite directions, to define, proximate to the pivot 314, a tooth or pawl 315, interacting with the set of teeth, and, at the opposite end, a grip element 316 which protrudes out of said planar base 311 and can be operated by the user. Advantageously, it is possible to associate with the tooth 315 a movable tab adapted to allow the micrometric adjustment of its position with respect to the set of teeth 316.

The use of the closure device 307 in fact entails that, once the shoe has been put on, the skier move the quarters close to one another, performing the fastening thereof by engaging the tooth 315 of the lever 313 in the selected point of the transverse set of teeth 306.

This step is facilitated by the configuration of said lever 313 which allows, by virtue of the presence of the grip element 316 and of the eccentric pivoting with respect to the opening 312, to impart thereto a simple and rapid rotation.

Since the wings 309 and 310 are pivoted to the front quarter 303, the more the skier raises the rod-like element 308 and therefore causes said transverse body portion to move past said curved rear region 305 in a plane perpendicular to the pivot axis and the interaction of the tooth 315 with the set of teeth 306 in a position more proximate to the upper end 317 of the rear quarter 304, the greater the degree of fastening between the two quarters, the front one and the rear one.

Moreover, the fastening pressure achieved is constant during flexing while skiing regardless of its value.

It should be noted that, since there is no interdependence between the degree of securing and degree of inclination of the boot, a better fit for the skier is achieved, increasing the feeling of comfort.

Figure 22:
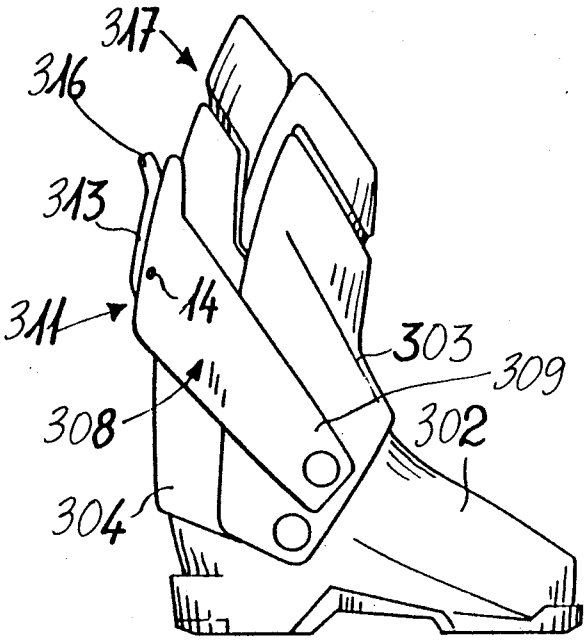
FIGS. 21 and 22 are lateral elevation views of a boot with a device according to a fourth aspect of the invention.
Figure 21:
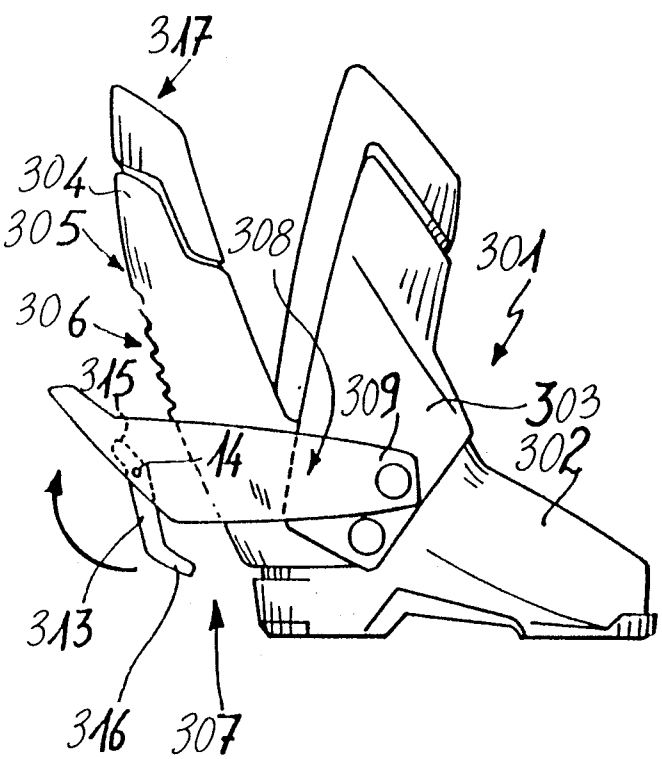
Figure 23:
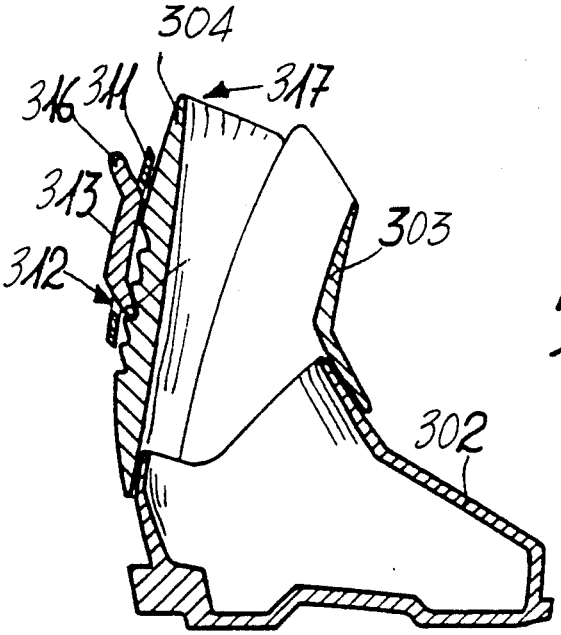
FIG. 23 is a cross section view along the middle longitudinal plane of the boot.
Figure 24:
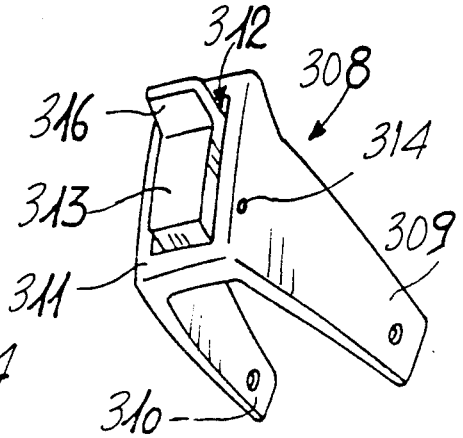
FIG. 24 is a perspective view of a detail of the device.

The subsequent unlocking step is similarly rapid and simple; in fact, as is illustrated in FIGS. 22 and 23, it is sufficient to push outwards, for example by means of the other boot, the grip element 316, imparting a slight rotation to the lever 313 and therefore uncoupling the tooth 315 from the set of teeth 306.

The smaller radius of rotation of the rod-like element, due to its pivoting to the front quarter 303 and not to the shell 302, furthermore allows to obtain a stop during its lowering since it abuts with the rear quarter 304.

Finally, FIGS. 25–27 illustrate a closure and adjustment device according to yet another aspect of the invention.

A rear-entry boot 401 comprises a rear quarter 404 and a front quarter 403 connected to a shell 402. The rear quarter 404 is provided, at its rear outer surface, with a transverse set of teeth 406 which can be, for example, similar to the wet of teeth described in detail in FIGS. 15–16.

The shell 402 is provided, on each side, with a hole 416 wherein is inserted a stud 407 for the pivoting of the front quarter 403 and of the rear quarter 404. A slot 405, preferably in the shape of an arc of a circle having its center at the hole 416, is provided above the hole 416 and slightly advanced on said shell 402.

The front quarter 403 is provided with a hole 408 at the slot 405 which is such that, by rotating said quarter around the stud 407, the hole 408 is always superimposed on the slot 405. A connecting rivet 409 is inserted in the hole 408 and in the slot 405; advantageously, both sides of the boot are provided with the abovementioned slot 405, hole 408 and rivet 409 so that the ends of a substantially U-shaped rod-like element, or bracket 417 are connected to the two rivets 409. The bracket 417 consists of two lateral wings 419, of which only one is visible in FIG. 25, rearwardly joined by a rear cross-member 421.

Each of the lateral wings 419 is provided, as described above, with the front end pivoted to the rivet 409, and is preferably arranged between the shell 402 and the front quarter 403 as illustrated in FIG. 26. The rear portion of the flap 419 is instead arranged outside the rear quarter 404 so that the bracket 417 rearwardly embraces said quarter 404, so that the rear cross-member 421 is arranged at the set of teeth 406. A roller 424 is provided at the cross-member 421 and is adapted to interact with the set of teeth 406 to adjust the closure of the quarters as previously described in detail, with particular reference to FIGS. 12–17. Also in this case, it is possible to provide at the cross-member 421 a block for the adjustment of the excursion of the roller similar to the one described in FIGS. 18–20.

The closure of the quarters and the adjustment of the securing occurs, as mentioned, in a manner fully similar to what has been described previously; furthermore, the front quarter remains rigidly associated with the rear quarter in rotation with respect to the pivoting stud 407, this rotation, that is to say forward inclination, being allowed by the presence of the slot 405.

With this type of connection the degree of fastening of the quarters remains constant during flexing and, conversely, the angle of longitudinal inclination of the quarters with respect to the shell is independent from the degree of fastening of said quarters, in the case, for example, that between the front quarter and the shell a known inclination adjustment device is interposed. Moreover, the front quarter is provided with a good return capacity during the extension step since it is directly coupled to the bracket.

In practice it has been observed that the invention, according to the various aspects described and illustrated, achieves the intended aim and objects by providing a device which allows the adjustment of the closure of the quarters with an easy and rapid operation, as well as the simultaneous adjustment of their inclination and flexing stroke.

Moreover, the presence of a rigid element interconnecting the quarters and the shell confers a greater overall rigidity to the boot, thus obtaining a good resistance to lateral splayings of the front quarter and a good rear hold, as well as an excellent transmission of lateral stresses.

The greater overall rigidity of the boot thus structured allows the possible reduction of the thicknesses of the shell and of the quarters, allowing a considerable reduction in weight.

Finally, the structural simplicity of the device associates an appealing aesthetic aspect to simplicity and reliability in use.

The device thus conceived is susceptible to numerous modifications and variations, all of which are within the scope of the inventive concept; moreover, all the details may be replaced with technically equivalent elements.

In practice, the materials employed, as well as the dimensions, may be any according to the requirements and to the state of the art.

We claim:

1. In a ski boot of the rear entry type having a shell, a front quarter including an instep portion and a rear quarter with a rear surface and with attachment means for pivotally connecting said front and rear quarters to said shell, an adjustable closure device for releasably closing said rear quarter against said front quarter to secure a skier's boot therebetween, comprising a U-shaped bracket member including a pair of leg-like elements having free ends and rear ends and extending along each side of said front and rear quarters, said U-shaped bracket member having a transverse body portion connecting said leg-like elements approximately at the rear ends thereof and arranged to face the rear surface of said rear quarter, pivot means defining a pivot axis for pivotally fastening the front ends of said leg-like elements on said front quarter, thereby to allow said transverse body portion to move past said rear surface of said rear quarter in a plane perpendicular to said pivot axis when said leg-like elements are rotated about said pivot axis, said rear quarter having a toothed formation protruding rearwardly from said rear surface thereof, said transverse body portion having lever means pivotally attached thereon and movable from an opening position into a closed position thereof and vice versa, said lever means having at least one pawl formation engageable with said toothed formation in closed position of said lever means.

2. A device according to claim 1, wherein said transverse body portion is in the form of a planar base having a recess for receiving therein said lever means.

3. A device according to claim 1, wherein said transverse body portion is in the form of a planar base having a recess for receiving therein said lever means and wherein said recess has a lower end thereof and wherein said lever means have hinge means for pivotal attachment on said planar base, said hinge means being arranged near said lower end.

4. A device according to claim 1, wherein said lever means comprise a lever having an upper end and a lower end curved in opposite directions, said lower end defining said pawl formation engageable with said toothed formation, said upper end defining a grip element for the user.

5. A device according to claim 1, wherein said rear surface has a curved profile with the convexity facing outwards.

6. A device according to claim 1, wherein said pawl formation has a movable tab with micrometric position adjustment means.

7. In a ski boot of the rear entry type having a shell, a front quarter including an instep portion and a rear quarter with a rear surface and with attachment means for pivotally connecting said front and rear quarters to said shell, an adjustable closure device for releasably closing said rear quarter against said front quarter to secure a skier's foot therebetween, comprising a U-shaped bracket member including a pair of leg-like elements having free ends and rear ends and extending along each side of said front and rear quarters, said U-shaped bracket member having a transverse body portion connecting said leg-like elements approximately at the rear ends thereof and arranged to face the rear surface of said rear quarter, pivot means defining a pivot axis for pivotally fastening the front ends of said leg-like elements on said front quarter, thereby to allow said transverse body portion to move past said rear surface of said rear quarter in a plane perpendicular to said pivot axis when said leg-like elements are rotated about said pivot axis, said rear quarter having a toothed formation protruding rearwardly from said rear surface thereof, said transverse body portion having lever means pivotally attached thereon and movable from an opening position into a closed position thereof and vice versa, said lever means holding at least one pawl formation engageable with said toothed formation in closed position of said lever means, wherein said transverse body portion is in the form of a planar base having a recess for receiving therein said lever means and wherein said recess has a lower end thereof and wherein said lever means have hinge means for pivotal attachment on said planar base, said hinge means being arranged near said lower end and wherein said lever means comprise a lever having an upper end and a lower end curved in opposite directions, said lower end defining said pawl formation engageable with said toothed formation, said upper end defining a grip element for the user.

* * * * *